United States Patent [19]

Todorovic

[11] 4,068,986

[45] Jan. 17, 1978

[54] SEALING MEANS FOR RADIAL FACES OF PISTON IN ORBITAL PISTON DEVICE

[76] Inventor: Vukasin Todorovic, 220 Littleton Road, Parsippany, N.J. 07054

[21] Appl. No.: 772,125

[22] Filed: Feb. 25, 1977

[51] Int. Cl.[2] ..... F01C 1/02; F02B 53/00; F01C 19/08

[52] U.S. Cl. ..... 418/61 R; 418/142; 277/81 P; 277/222; 267/1.5

[58] Field of Search ..... 277/81 P, 222; 418/61 R, 104, 122, 142; 267/1.5

[56] References Cited

U.S. PATENT DOCUMENTS

| | | | |
|---|---|---|---|
| 3,139,233 | 6/1964 | Simonsen | 418/142 X |
| 3,180,563 | 4/1965 | Jones et al. | 418/142 X |
| 3,400,939 | 9/1968 | Jones | 418/142 X |
| 3,885,799 | 5/1975 | Bibbens | 277/81 P |
| 3,923,431 | 12/1975 | Abbey | 418/61 R |
| 3,953,159 | 4/1976 | Hunter | 418/61 R |
| 4,005,953 | 2/1977 | Ruf | 418/142 |

*Primary Examiner*—Robert S. Ward, Jr.

*Attorney, Agent, or Firm*—Lerner, David, Littenberg & Samuel

[57] ABSTRACT

Improved sealing means are provided for a motor, engine, or pump having a piston mounted for orbital motion within a cylinder housing, with the housing including radial faces and a plurality of combustion chambers. The improved sealing means are disposed in a groove in at least one of the radial faces of the piston to prevent leakage of working fluid in a circumferential direction between adjacent combustion chambers. The sealing means is comprised of an annular seal ring including an annular band, the band having a plurality of spaced extension members which define pockets therebetween. Each of the pockets has disposed therein a circumferential sealing member and spring means, with each of the spring means operating to bias the annular band into engagement with one of the radial faces of the cylinder housing to prevent leakage of working fluid in a radial direction. Each of the circumferential sealing members prevents working fluid from escaping from its corresponding pocket and leaking in a circumferential direction to an adjacent combustion chamber.

7 Claims, 5 Drawing Figures

SEALING MEANS FOR RADIAL FACES OF PISTON IN ORBITAL PISTON DEVICE

FIELD OF THE INVENTION

The present invention relates generally to orbital motors, engines, compressors, or pumps, and particularly to such devices having improved sealing means which prevent working fluid from leaking in a circumferential direction to adjacent combustion chambers.

BACKGROUND OF THE INVENTION

The problem of properly sealing motors, engines, or pumps having a piston mounted for rotation within a cylinder housing has existed for a long time. In addition, there have been numerous attempts over the years to develop improved sealing means which are simple in construction and efficient in operation. Typically, seals are employed to prevent leakage of working fluid in a radial direction between the radial faces of the piston and the radial faces of the motor housing which the rotating piston engages. Seals for preventing such radial leakage of working fluid have been generally satisfactory. However, such seals have the drawback of not being able to prevent leakage of working fluid in a circumferential direction between adjacent combustion chambers. More particularly, as a piston orbits, working fluid enters a particular combustion chamber and must be prevented from leaking to an adjacent combustion chamber, which leaking would result in decreased pressure and decreased engine efficiency. Although present seals are generally satisfactory in preventing leakage of working fluid in a radial direction, such seals do not prevent the leakage of working fluid in a circumferential direction. Accordingly, it would be highly desirable to provide a seal construction which accomplishes the foregoing.

Broadly, it is an object of the present invention to provide improved sealing means which overcomes the aforesaid problems. Specifically, it is within the contemplation of the present invention to provide an improved seal which is constructed to prevent leakage of working fluid in a radial direction between the radial faces of the piston and the radial faces of the cylinder housing and also prevents leakage of fluid in a circumferential direction between adjacent combustion chambers.

It is a further object of the present invention to provide an improved sealing means which are aligned with the combustion chambers so that leakage of working fluid is prevented between adjacent combustion chambers.

SUMMARY OF THE INVENTION

Briefly, in accordance with the principles of the present invention, an improved sealing means are provided for a motor, engine, or pump having a piston mounted for rotation within a cylinder housing, with the housing having radial faces and a plurality of combustion chambers. The improved sealing means are disposed in a groove formed in at least one of the radial faces of the piston. The improved sealing means comprise an annular seal ring including an annular band. The annular band includes a plurality of spaced extension members which define pockets therebetween. Each of the pockets has disposed therein a circumferential sealing member and spring means. Each of the spring means operates to bias the annular band into engagement with one of the radial faces of the cylinder housing to prevent leakage of working fluid in a radial direction. In addition, each of the circumferential sealing members prevents working fluid from escaping from its corresponding pocket and leaking in a circumferential direction to an adjacent combustion chamber. The extension members are aligned with the combustion chambers so that they prevent leakage of working fluid in the circumferential direction.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings.

DETAILED DISCUSSION OF PREFERRED EMBODIMENT OF THE INVENTION

Figure 1:
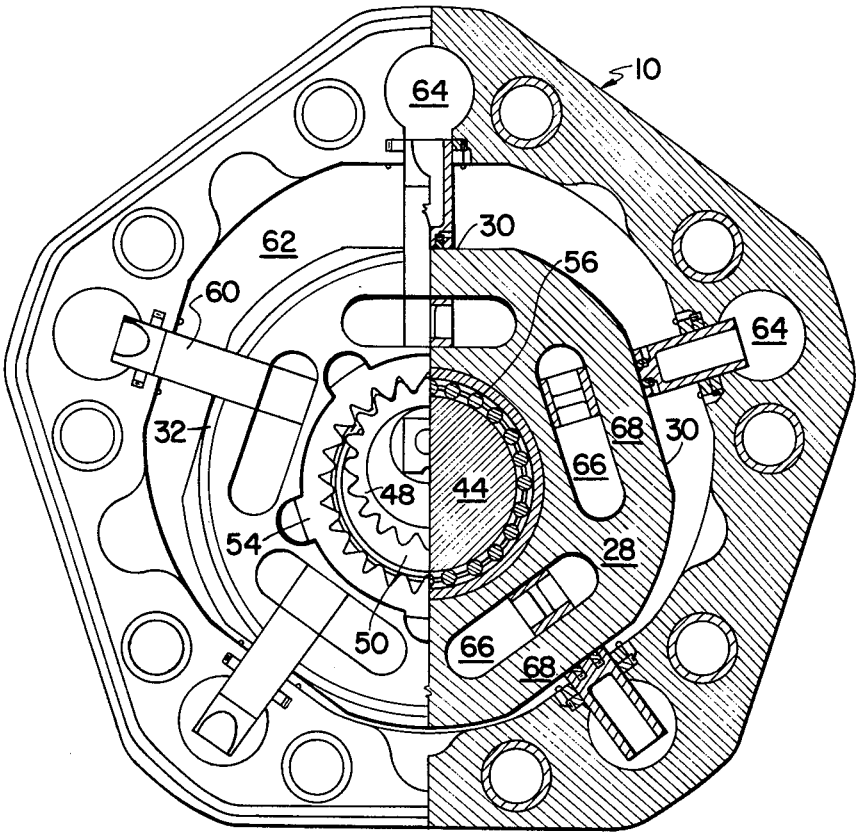
FIG. 1 is a cross-sectional view of a hydraulic motor including a preferred embodiment of this invention.

Referring to the drawings, the invention is illustrated in a hydraulic motor having a cylinder housing 10 which includes a front plate 12, an end plate 14, a cover 16, and a valve case 18 enclosing the working mechanism of the present invention. The cylinder housing 10 is generally cylindrical in shape having a central cavity forming a single cylinder 20 between front plate 12 and end plate 14. Cylinder housing 10 is also provided with admission and exhaust port 22 and other conventional features as are typically associated with hydraulic motors.

A single orbitor or piston 28 is located within the cylinder 20. The piston 28 is generally cylindrical in shape, except that it is provided with a number of flat portions 30 (hereinafter "flat") around its circumference. As shown in the drawings, five flats 30 are preferred; however, this number may be varied with the number of vanes as will be seen more fully below. As will be more fully explained, the radial faces of piston 28 are also provided with sealing rings 32, 33 on each radial face near the outer periphery of the piston and preferably conforming to the peripheral contour thereof. When the front and end plates 12, 14 are assembled, piston rings 32, 33 engage the radial faces of plates 12, 14, respectively, to seal the cylinder 20 against leakage.

Figure 2:
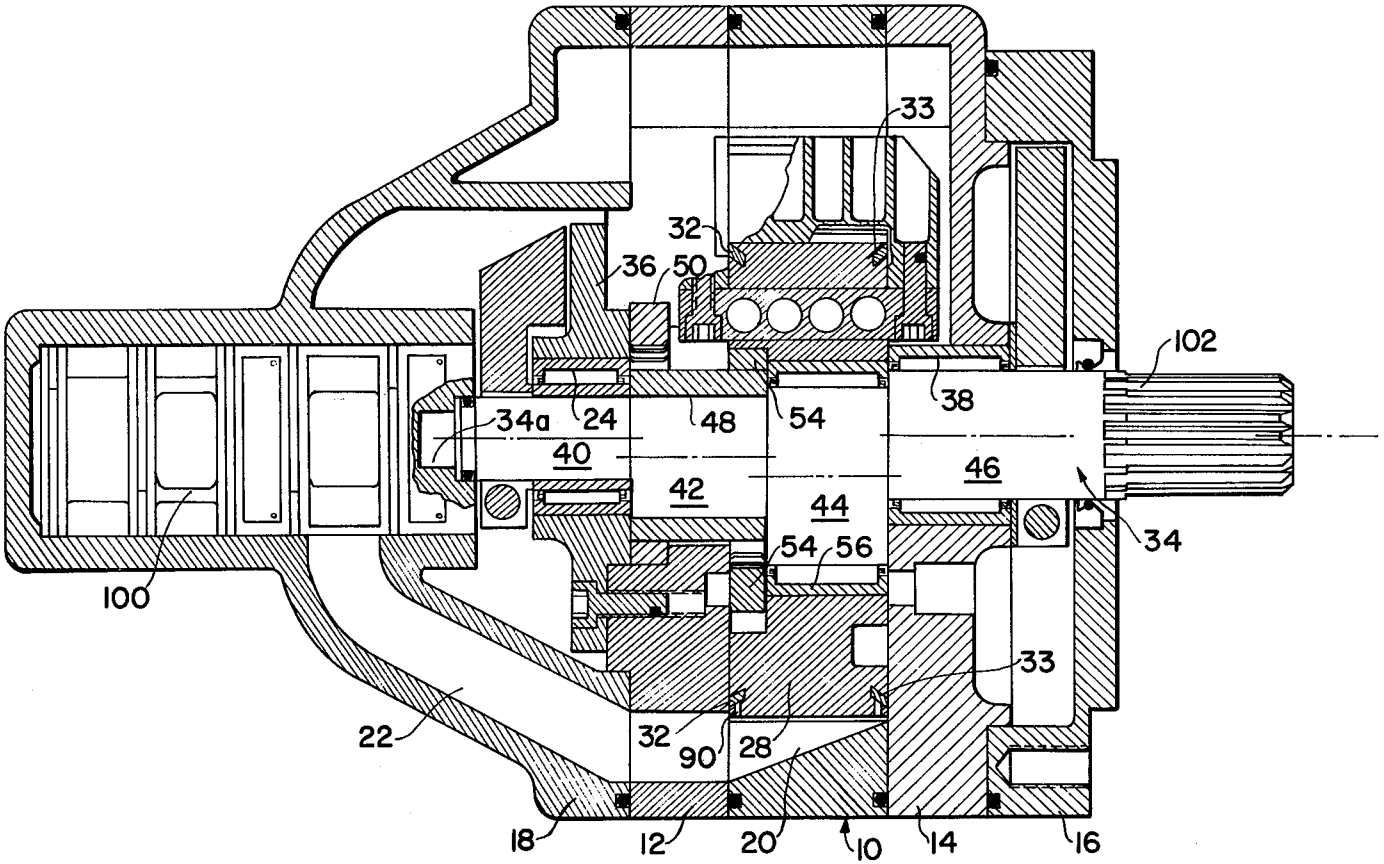
FIG. 2 is a sectional view of the motor taken along the main axis of the shaft.

A primary shaft, generally designated 34, is journalled for rotation relative to cylinder housing 10. The shaft 34 preferably includes a front section 40, a first eccentric section 42, a second eccentric section 44, and a rear section 46, as best shown in FIG. 2. The front and rear sections are centered about a common axis (primary axis), and the front section 40 is journalled by a roller bearing 24 in a flange 36 which is connected to front plate 12. The rear section 46 is journalled by a roller bearing 38 in end plate 14. The rear section 46 of the shaft may be of a larger diameter than the front section 40 so that it may bear a heavier load or torque; however, the axes of the front and rear sections are coincident with each other. Further, as the shaft 34 is supported in the motor, the axes of the front and rear sections of the shaft 34 coincide with the cylindrical axis of the cylinder housing 10 and cylinder 20.

The length of each portion of the shaft 34 is determined by the arrangment of the piston and gearing as follows. An external gear or pinion 48 is rotatably mounted on the first eccentric section 42 of the shaft 34. A first internal or ring gear 50 is centered about the main axis and is fixedly mounted relative to the front end plate 12. This first ring gear 50 will be referred to as the "fixed ring gear." A second, orbiting ring gear 54 is preferably identical to the first in diameter and in numbers of teeth, but the orbiting ring gear 54 is centered about the second eccentric axis. The orbiting ring gear 54 is not mounted directly on the second eccentric section 44 of the shaft 34, but it is fixed relative to piston 28. Piston 28 is rotatably mounted on the second eccentric section 44 on shaft 34 by a roller bearing 56. It may be seen, therefore, that the orbiting ring gear 54 and the piston 28 are connected to each other and are rotatably mounted as one unit on the second eccentric section 44 of the shaft 34.

It may be seen from this description that the fixed ring gear 50 will engage the pinion 48 along an axis which is parallel to the two eccentric axes, and that orbiting ring gear 54 will engage the pinion 48 at a point on the pinion diametrically opposite to the point of engagement of the fixed ring gear 50 with the pinion 48. Further, the diametric opposition of these two points of engagement will be the same regardless of the position of the piston and shaft through the motor cycle. In effect, the two ring gears 50, 54 form a cage within which the captive pinion 48 may roll. Since the fixed ring gear 50 is prevented from rotating by being splined at 50a to front plate 12, the only possible motion which the orbiting ring gear 54 may exhibit is orbital motion, absolutely devoid of rotation. Since the orbiting ring gear 54 and piston 28 and fixedly connected, piston 28 can only orbit and not rotate as the shaft 34 is turned.

Preferably, this motor is provided with five vanes 60 defining five distinct combustion chambers 62, as seen in FIG. 1. The vanes 60 are slidingly received in openings 64 formed partly in the cylinder housing 10 and partly in plates 12, 14. Each opening 64 is aligned radially with respect to the main axis of the shaft 34, and it should be evident that as piston 28 orbits within the cylinder 20, the vanes 60 will slide in and out of openings 64. Piston 28 is also provided with five piston slots 66 which define bridges 68 between each piston slot 66 and each flat 30 on the periphery of the piston 28. The piston slots 66 are aligned tangentially with respect to the main axis of shaft 34 and extend fully through the piston. The vanes 60 are slideably mounted on the bridges 68 so that the vanes 60 slide with respect to flats 30 of the piston 28 as it orbits. It may now be seen that all sliding movement in this motor will occur on flat surfaces and that the direction of movement will be perpendicular to said surfaces.

This fluid motor is also provided with conventional parts, such as a rotary valve 100 and a spline output shaft 102. The rotary valve 100 may be controlled in a conventional manner, such as being connected to shaft square **34*a***.

Figure 3:
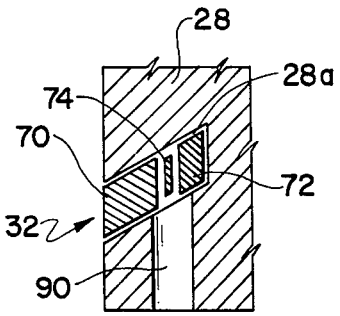
FIG. 3 is a cross-sectional view of the improved combustion sealing means of the present invention.
Figure 4:
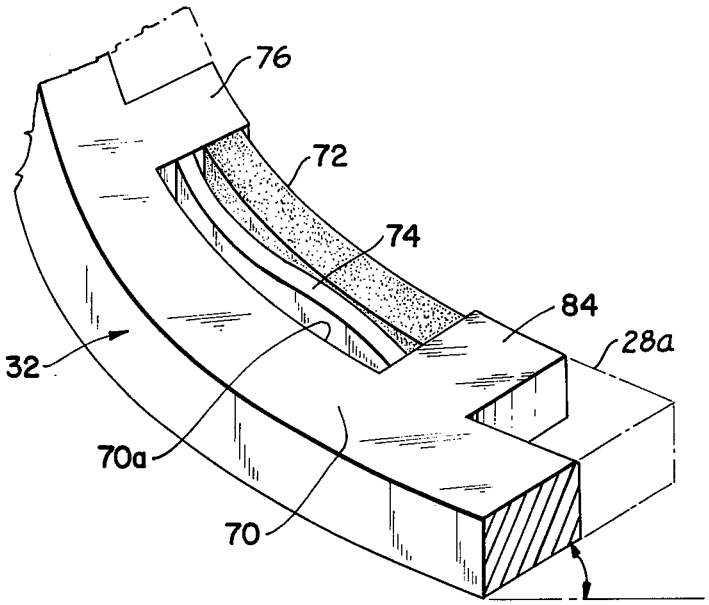
FIG. 4 is a partial perspective view of the sealing means of the present invention.
Figure 5:
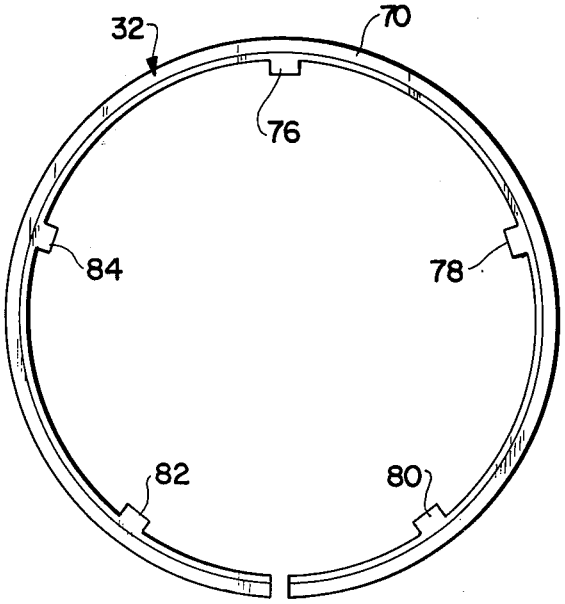
FIG. 5 is a detailed view of the combustion sealing means removed from the piston.

Turning now to FIGS. 3, 4, and 5, there is shown in detail the improved combustion sealing means of the present invention. As explained above, combustion seal 32 is located in one radial face of piston 28 which faces front plate 12, and the other combustion seal 33 is located on the other radial face of piston 28 which engages rear plate 14. As combustion seals 32, 33 are identical, only combustion seal 32 will be described in detail.

Combustion seal 32 is in the form of an annular ring and, as shown in FIG. 8, is disposed in an annular groove **28*a* formed in the radial face of piston 28. Combustion seal 32 is basically comprised of three parts: a metal band 70 which engages the radial face of front plate 12 of the cylinder housing 10; metal pads 72 disposed within pockets 70*a* formed in band 70 and which are located at the inner end of groove 28*a*; and spring strips 74 disposed between metal band 70 and metal pads 72 which function to bias metal band 70 into engagement with front plate 12 so as to provide a good seal which prevents the leakage of working fluid between the radial face of piston 28 and the radial face of front plate 12**.

As shown most clearly in FIGS. 4 and 5, seal ring 32 is discontinuous so that it may be assembled into piston groove **28*a*. As piston groove 28*a* is at a slight angle with respect to the rotational axis of piston 28, in the range of 25° to 35°, it is necessary to have seal ring 32 discontinuous so that it can be more easily assembled into angled groove 28*a*. Moreover, it is advantageous to have groove 28*a* at an angle, as it avoids forming a seal groove in the end face of piston 28 which would result in the vanes sliding on the seals within the groove. Moreover, by having the groove 28*a* and seal ring 32 at an angle, with the open end of the groove adjacent the end face of the piston, the meta band 70 is at the periphery of piston 28 and prevents fluid leakage between the radial faces of piston 28 and front plate 12**.

The metal band 70 may be formed of any suitable metal, such as cast iron, and is provided with extension members or legs 76, 78, 80, 82, and 84 which are equally spaced about the seal ring 32. Pockets **70*a* are formed between the respective extension members, and each pocket is adapted to receive one of the spring strips 74 and one of the metal pads 72. Pads 72 may be formed of any suitable material, such as cast iron metal. As will be apparent from FIG. 1, seal ring 32 is disposed within the radial face of piston 28, such that each extension members 76 through 84 are aligned with the center of each flat face 30 of piston 28. In this manner, each pair of extension members is aligned with the boundaries of one of the combustion chambers 62**.

The combustion seals 32, 33 of the present invention function not only to prevent fluid leakage between the radial faces of piston 28 and the respective side faces of end plates 12, 14, but such improved combustion seals also function to prevent leakage of fluid between the respective combustion chambers 62, in a manner to be explained. More particularly, between each flat face 30 of piston 28, there are five fluid holes 90 formed in the end face of piston 28. Accordingly, as piston 28 orbits, the working fluid enters fluid holes 90, and as shown most clearly in FIG. 3, the working fluid will enter the area between metal band 70 and metal pad 72 about spring strip 74. In this maner, the pressure of the working fluid and spring strip 74 function to bias metal band 70 outwardly and into engagement with end plate 12 to provide a good seal between the radial face of piston 28 and the radial face of plate 12 and to prevent the leakage of fluid therebetween. However, as the working fluid is dispersed about the spring strip 74 in each pocket **70*a*, it is prevented from leaving the pocket 70*a* by the metal pad 72 and the respective extension members 76 through 84. That is, metal pad 72 seals each pocket 70a** by engaging the respective extension members and operates to prevent the fluid from passing above and around the extension members and along the piston groove 28*a*. Therefore, the working fluid, which is under pressure, is prevented from traveling in a circumferential direction from one combustion chamber to an adjacent one by the improved seal ring of the present invention.

In view of the foregoing, it will be understood that the improved seal rings 32, 33 of the present invention avoid the drawbacks of prior seal rings which did not prevent the working fluid which is under pressure from entering the area under the seal ring and passing from one combustion chamber to an adjacent one. As explained above, this is simply and efficiently avoided by the seal rings of the present invention.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. In a motor, engine, or pump having a piston mounted for rotation about an axis within a cylinder housing, said housing including radial faces and a plurality of combustion chambers, the improvement comprising sealing means disposed on at least one of the radial faces of said piston to seal said combustion chambers against leakage of working fluid. said sealing means comprising:

an annular seal ring including an annular band, said band including a plurality of spaced extension members which define pockets therebetween, each of said pockets having disposed therein a circumferential sealing member and spring means, each of said spring means operating to bias said annular band into engagement with one of the radial faces of said cylinder housing to prevent leakage of working fluid in a radial direction, and each of said circumferential sealing members preventing working fluid from escaping from its corresponding pocket and leaking in a circumferential direction to an adjacent combustion chamber.

2. The sealing means of claim 1 wherein said extension members are aligned with said combustion chambers so that said extension members prevent leakage of working fluid between adjacent combustion chambers.

3. The sealing means of claim 1 wherein each of said circumferential sealing members engage its corresponding extension members so that working fluid is prevented from leaking between adjacent ones of said combustion chambers.

4. The sealing means of claim 1 wherein said annular seal ring is disposed within an annular groove formed in the radial face of said piston, said groove being on an angle with respect to the rotational axis of said piston.

5. The sealing means of claim 1 wherein the number of said pockets is equal to the number of said combustion chambers.

6. The sealing means of claim 1 wherein said annular band is discontinuous so that it may be disposed within the radial face of said piston.

7. The sealing means of claim 1 wherein said annular band and said circumferential sealing members are formed of a material having substantially the same coefficients of expansion.

* * * * *